US008955263B2

(12) United States Patent
Hatzinikolas

(10) Patent No.: US 8,955,263 B2
(45) **Date of Patent: *Feb. 17, 2015**

(54) BREAK AWAY FIREWALL CONNECTION SYSTEM AND A METHOD FOR CONSTRUCTION

(75) Inventor: Michael Hatzinikolas, Edmonton (CA)

(73) Assignee: Fero Corporation, Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/098,908

(22) Filed: May 2, 2011

(65) Prior Publication Data

US 2012/0279143 A1 Nov. 8, 2012

(51) Int. Cl.

| | |
|---|---|
| ***E04C 1/00*** | (2006.01) |
| ***A62C 2/06*** | (2006.01) |
| ***A62C 2/24*** | (2006.01) |
| ***E04B 1/38*** | (2006.01) |
| ***E04B 1/94*** | (2006.01) |

(52) U.S. Cl.

CPC ... *A62C 2/06* (2013.01); *A62C 2/24* (2013.01); *E04B 1/38* (2013.01); *E04B 1/94* (2013.01)

USPC ..... 52/99; 52/298; 52/96; 52/702; 52/272; 52/279; 52/232

(58) Field of Classification Search

CPC ..... E04B 1/94

USPC ..... 52/1, 98, 99, 100, 289, 702, 713, 272, 52/279, 283, 254, 167.1, 232, 573.1; 248/548, 909; 403/2

See application file for complete search history.

(56) References Cited

U.S. PATENT DOCUMENTS

| | | | | | |
|---|---|---|---|---|---|
| 1,958,124 | A | * | 5/1934 | Bemis | 165/56 |
| 2,104,500 | A | * | 1/1938 | Van Buren | 52/220.1 |
| 2,382,584 | A | * | 8/1945 | Scheyer | 403/2 |
| 2,389,171 | A | * | 11/1945 | Urbain | 52/283 |
| RE22,905 | E | * | 8/1947 | Scheyer | 403/2 |
| 3,119,475 | A | | 1/1964 | Adams et al. | |
| 3,294,428 | A | | 12/1966 | Lickliter et al. | |
| 3,342,005 | A | * | 9/1967 | Rickards et al. | 52/702 |
| 3,691,712 | A | * | 9/1972 | Bowling et al. | 52/393 |
| 3,708,932 | A | | 1/1973 | Bailey et al. | |
| 3,974,607 | A | * | 8/1976 | Balinski | 52/232 |
| 4,245,446 | A | * | 1/1981 | Judkins | 52/232 |

(Continued)

FOREIGN PATENT DOCUMENTS

| | | | | |
|---|---|---|---|---|
| BE | 1010572 | A6 * | 10/1998 | |
| JP | 03279556 | A * | 12/1991 | E04F 13/08 |
| JP | 04343951 | A * | 11/1992 | E04B 5/02 |

*Primary Examiner* — Joshua J Michener
*Assistant Examiner* — Matthew Gitlin
(74) *Attorney, Agent, or Firm* — Bereskin & Parr LLP/S.E.N.C.R.L., s.r.l.; Kenneth Bousfield

(57) ABSTRACT

A break away connector system is provided for coupling together structural elements, such as a firewall and a floor or ceiling. The break away connector system comprises a support member and a fusible member. The support member is connectable to a firewall for securing a floor or ceiling to the firewall. The break away connector system further comprises at least one securing member for connecting the floor or ceiling to the support member. The fusible member has a lower melting point than the support member. The support member is configured such that when the fusible member is weakened by heat, the floor or ceiling is slidably releasable from the support member. In a further embodiment, a method is provided for constructing a firewall connection system.

38 Claims, 13 Drawing Sheets

(56) References Cited

U.S. PATENT DOCUMENTS

| | | | | | |
|---|---|---|---|---|---|
| 4,341,051 | A * | 7/1982 | Sim et al. | 52/702 |
| 4,473,984 | A * | 10/1984 | Lopez | 52/410 |
| 4,514,952 | A * | 5/1985 | Johansson | 52/713 |
| 4,523,413 | A * | 6/1985 | Koppenberg | 52/139 |
| 4,575,983 | A * | 3/1986 | Lott et al. | 52/544 |
| 4,852,847 | A * | 8/1989 | Pagel | 248/548 |
| 5,163,256 | A * | 11/1992 | Fukumoto et al. | 52/167.1 |
| 5,438,811 | A * | 8/1995 | Goya | 52/702 |
| 5,619,824 | A * | 4/1997 | Russell et al. | 52/1 |
| 5,711,122 | A * | 1/1998 | Lee | 52/283 |
| 5,720,571 | A * | 2/1998 | Frobosilo et al. | 403/403 |
| 6,128,883 | A * | 10/2000 | Hatzinikolas | 52/698 |
| 6,311,449 | B1 * | 11/2001 | Morse et al. | 52/702 |
| 6,367,212 | B1 * | 4/2002 | Manning | 52/232 |
| 6,430,890 | B1 * | 8/2002 | Chiwhane et al. | 52/715 |
| 6,463,710 | B1 * | 10/2002 | Barnhart | 52/698 |
| 7,047,695 | B2 * | 5/2006 | Allen et al. | 52/120 |
| 7,503,150 | B1 * | 3/2009 | diGirolamo et al. | 52/702 |
| 7,520,095 | B2 | 4/2009 | Platt et al. | |
| 7,703,244 | B2 * | 4/2010 | Suzuki et al. | 52/167.3 |
| 7,712,282 | B2 * | 5/2010 | Robertson et al. | 52/712 |
| 7,765,764 | B2 * | 8/2010 | Zambelli et al. | 52/702 |
| 8,122,679 | B2 * | 2/2012 | Tonyan et al. | 52/745.13 |
| 2002/0184836 | A1 * | 12/2002 | Takeuchi et al. | 52/167.1 |
| 2003/0159376 | A1 * | 8/2003 | Huynh | 52/208 |
| 2005/0160683 | A1 * | 7/2005 | Eldeen | 52/73 |
| 2010/0037552 | A1 * | 2/2010 | Bronner | 52/713 |

* cited by examiner

BREAK AWAY FIREWALL CONNECTION SYSTEM AND A METHOD FOR CONSTRUCTION

FIELD

This invention relates to a break away connector for connecting structural components, such as a floor or ceiling to a firewall. This invention also relates to a method of constructing a firewall connection system.

INTRODUCTION

In residential, commercial and industrial structures, it is desirable to have separate dwelling spaces defined by structural members that are designed to slow or prevent the spread of fire between adjacent spaces. These structural members may be firewalls. The use of firewalls in structures, such as buildings, is known in the art. Firewalls are typically designed and/or treated to resist combustion and prevent rapid heat transfer. Most commonly, firewalls are substantially vertical partitions that define interior spaces such as individual rooms within the same structure, or interior spaces of separate, adjacent structures.

In some multi-level buildings, structural members are supported by at least one firewall. Commonly, substantially horizontal structural components such as floors or ceilings are tied into at least one substantially vertical firewall. In the event that a heat-inducing event occurs within an interior space that is at least partially defined by a firewall, it is desirable for certain structural members to be releasable from the firewall. If a structural member catches fire, it is beneficial for the structural member to be releasable from the firewall to separate the heat source from the firewall. This release can allow the firewall to remain in tact for a longer duration. As a result, firefighters may be provided with sufficient time to prevent the spread of fire to adjacent spaces. In some cases, occupants in an adjacent room/structure may be provided with sufficient time to escape before the firewall is compromised and the fire spreads to the adjacent space.

Structural connectors comprising a fusible member are generally known in the art. See for example U.S. Pat. Nos. 3,119,475; 3,294,428; 3,708,932 and 7,520,095. As described in these patents, when at least one fusible member is weakened by heat, at least one structural member is permitted to move relative to another. These patents disclose the use of fusible members to accommodate the thermal expansion of at least one heated structural member, to reduce such undesirable consequences as thermal buckling.

U.S. Pat. No. 3,708,932 discloses the use of a fusible break away clip to releasably couple structural members. This patent discloses fusible break away clips that are made of a material that will burn or melt when subjected to fire. As disclosed, the clips are used to couple a structural member to a fire barrier member. When there is a fire on one side of the fire barrier member, the break-away clips may melt and disengage the structural member from the remainder of the wall structure.

SUMMARY

The following summary is provided to introduce the reader to the more detailed discussion to follow. The summary is not intended to limit or define the claims.

According to one broad aspect of this disclosure, a break away connector system comprises a support member and a fusible member. The support member is connectable to a firewall for securing a floor or ceiling to the firewall. The support member is connectable to the floor or ceiling by at least one securing member. Any means known in the art to secure a support member to a floor or ceiling may be used. The fusible member has a lower melting point than the support member. The support member and the fusible member are configured such that, when the fusible member is weakened by heat, the floor or ceiling is slidably releasable from the support member.

The support member preferably has a horizontally extending support surface that is connected to the floor or ceiling. Accordingly, when the fusible member is at room temperature, the break away connector system provides the required support. However, when the fusible member weakens due to heat, then the floor or ceiling my slide relative to the support member and thereby become separated from the firewall.

An advantage of this configuration is that when the floor or ceiling catches fire, the fusible member is weakened and the floor or ceiling is slidably releasable from the support member. This release may space a floor or ceiling that is on fire from the firewall by a sufficient amount to allow the firewall to remain in tact for a longer duration of time. In some cases, this extra time may allow occupants of an adjacent space to escape before the fire spreads to that space. In some instances, the floor or ceiling may completely disengage from the support member thereby allowing the floor or ceiling to fall.

Another advantage of this design is that the support member may provide support for a structural member under normal conditions. Accordingly, the loading bearing capacity of the break away connector system is not limited by the load bearing capabilities of the fusible member itself.

Optionally, the fusible member may also have a channel through which the securing member extends. Accordingly, another advantage associated with embodiments of the present invention is that the fusible member may not necessarily have to burn all the way though in order to release a structural member, such as a floor or ceiling, from a firewall. As a result, the release may occur shortly after the break away connector system is subjected to heat. This may allow the structural components to separate from one another sooner, thereby increasing the duration of time for which a firewall remains in tact.

The support member may have a disengagement end and at least one channel that has an open end at the disengagement end.

The fusible member may have at least one opening therethrough that is alignable with the channel of the support member. Preferably, at least one securing member is extendable through both the support member and the fusible member to secure the support member to the floor or ceiling.

In some cases, the opening of the fusible member may be an open ended channel that is alignable with the at least one channel of the support member.

The fusible member may be lockingly securable to the support member. In some embodiments, the support member and the fusible member may have mating engagement members. Preferably, the engagement member of the support member comprises a protrusion and the engagement member of the fusible member comprises a groove. In some cases, the fusible member comprises an opening that is an open ended channel and the groove extends at an angle to the opening of the fusible member.

The support member may be configured for slidable release of the floor or ceiling from the support member with the at least one securing member attached to the floor or ceiling when the fusible member is weakened by heat. In some cases, the support member may be fixedly secured to the firewall when the floor or ceiling is slidably disengagable from the support member.

The support member may be made of metal or plastic, preferably metal. The fusible member may be made of plastic or metal, preferably plastic.

In some cases, the support member may be an angle having a first section fixedly securable to a face of the firewall and having a second section substantially orthogonal to the first section. Preferably, the second section has at least one channel.

According to another broad aspect of this disclosure, a method is provided for constructing a firewall connection system. The method comprises (a) providing a support member and a fusible member whereby at least one securing member is slidably removable from the support member when the fusible member is weakened by heat;

(b) securing a first section of a support member to a first structural member; and, (c) securing a second section of the support member to a second structural member by passing the at least one securing member through the second section of the support member and the fusible member and into the second structural member.

The support member may have at least one open ended channel. In this embodiment, securing the second section of the support member to a second structural member may comprise passing the at least one securing member through the at least one open ended channel.

The fusible member may have at least one opening. In this embodiment, securing the second section of the support member to a second structural member may comprise passing the at least one securing member through the at least one opening.

In some embodiments, the fusible member may be positioned in an abutting relationship with the support member.

In some embodiments, the support member and the fusible member may be interengaged.

DRAWINGS

Reference is made in the description of various embodiments to the accompanying drawings, in which.

DESCRIPTION OF VARIOUS EMBODIMENTS

Various apparatuses or methods will be described below to provide an example of each claimed invention. No invention described below limits any claimed invention and any claimed invention may cover processes or apparatuses that are not described below. The claimed inventions are not limited to apparatuses or processes having all of the features of any one apparatus or process described below, or to features common to multiple or all of the apparatuses described below. It is possible that an apparatus or process described below is not an embodiment of any claimed inventions.

Figure 1:
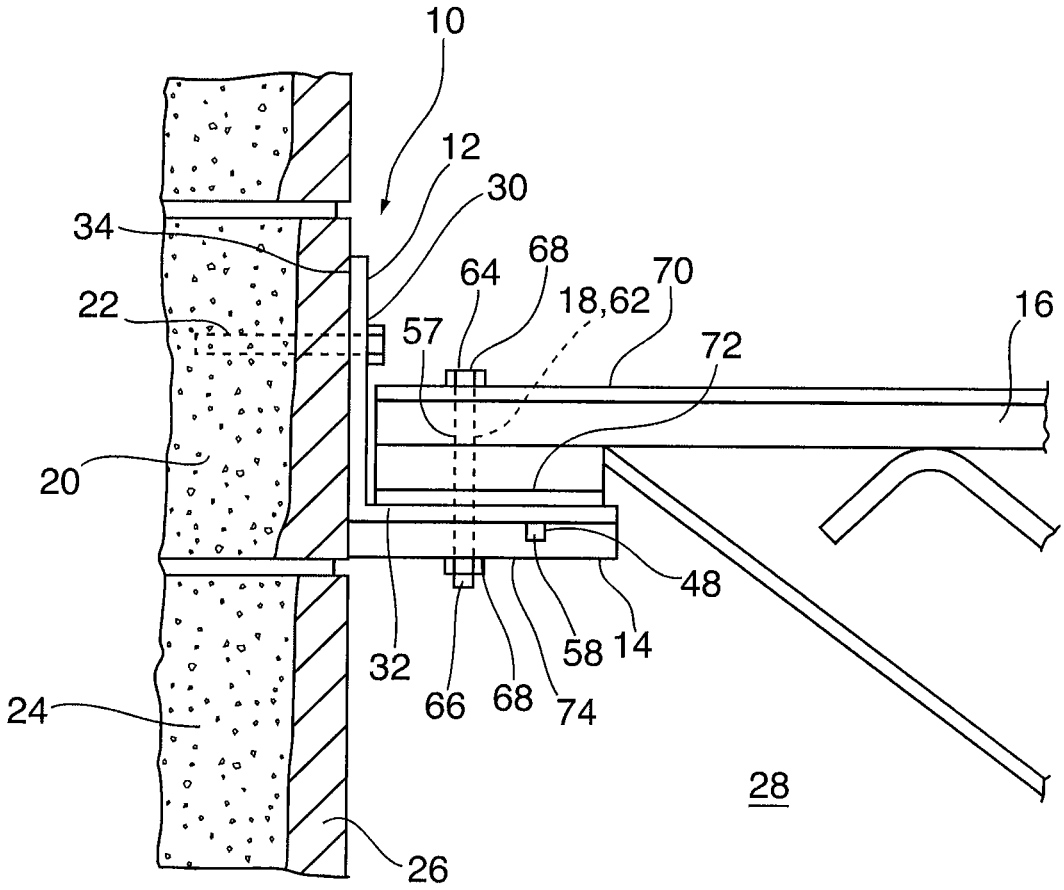
FIG. 1 is a side view of an examplary break away connector system in accordance with an embodiment of the invention, showing the break away connector system in an assembled state.

FIG. 1 illustrates an exemplary break away connector system 10 for a firewall. As illustrated, break away connector system 10 comprises support member 12 and fusible member 14. Support member 12 is connectable to a floor or ceiling 16 by at least one securing member 18. Support member 12 is also connectable to firewall 20 for securing floor or ceiling 16 to firewall 20. Support member 12 may be connectable to firewall 20 by an attachment member 22. Fusible member 14 of the break away connector system has a lower melting point than support member 12. Support member 12 is configured for slidable release of the floor or ceiling 16 from the support member when fusible member 14 is weakened by heat.

Firewalls, such as firewall 20, are known in the art. Firewalls limit the spread of fire or heat from one space to another. Firewalls may be made from materials such as concrete, reinforced concrete, or masonry blocks and may comprise multiple layers. As illustrated in FIG. 1, firewall 20 comprises masonry blocking 24 having a gypsum board layer 26 disposed thereon. Most commonly, firewall 20 is a substantially vertical wall. Firewall 20 defines an interior space 28. Interior space 28 may be an interior portion of a residential, industrial or commercial structure, such as a building. Firewall 20 may define individual rooms within the same structure, or may provide a partition between adjacent structures.

As illustrated in FIG. 1, a floor or ceiling 16 is connectable to the firewall 20 by break away connector system 10. Most commonly, floor or ceiling 16 comprises a substantially horizontal beam or joist that is connectable to a substantially vertical firewall (such as firewall 20 illustrated in FIG. 1). The floor or ceiling 16 may take several forms. As non-limiting examples, the floor or ceiling 16 that is connectable to firewall 20 may comprise an I-beam, C-channel, U-channel, solid rectangular joist, or the like. The floor or ceiling 16 that is connectable to firewall 20 may be made of materials such as wood, steel, concrete, reinforced concrete, composite material or the like, or any combination thereof.

FIG. 1 illustrates floor or ceiling 16 coupled to firewall 20 by break away connector system 10 in an assembled state. The break away connector system 10, floor or ceiling 16 and firewall 20 are in the assembled state under normal conditions. FIG. 1 illustrates the assembled state in the absence of a heat-inducing event, such as a fire or explosion, within interior space 28.

Figure 2:
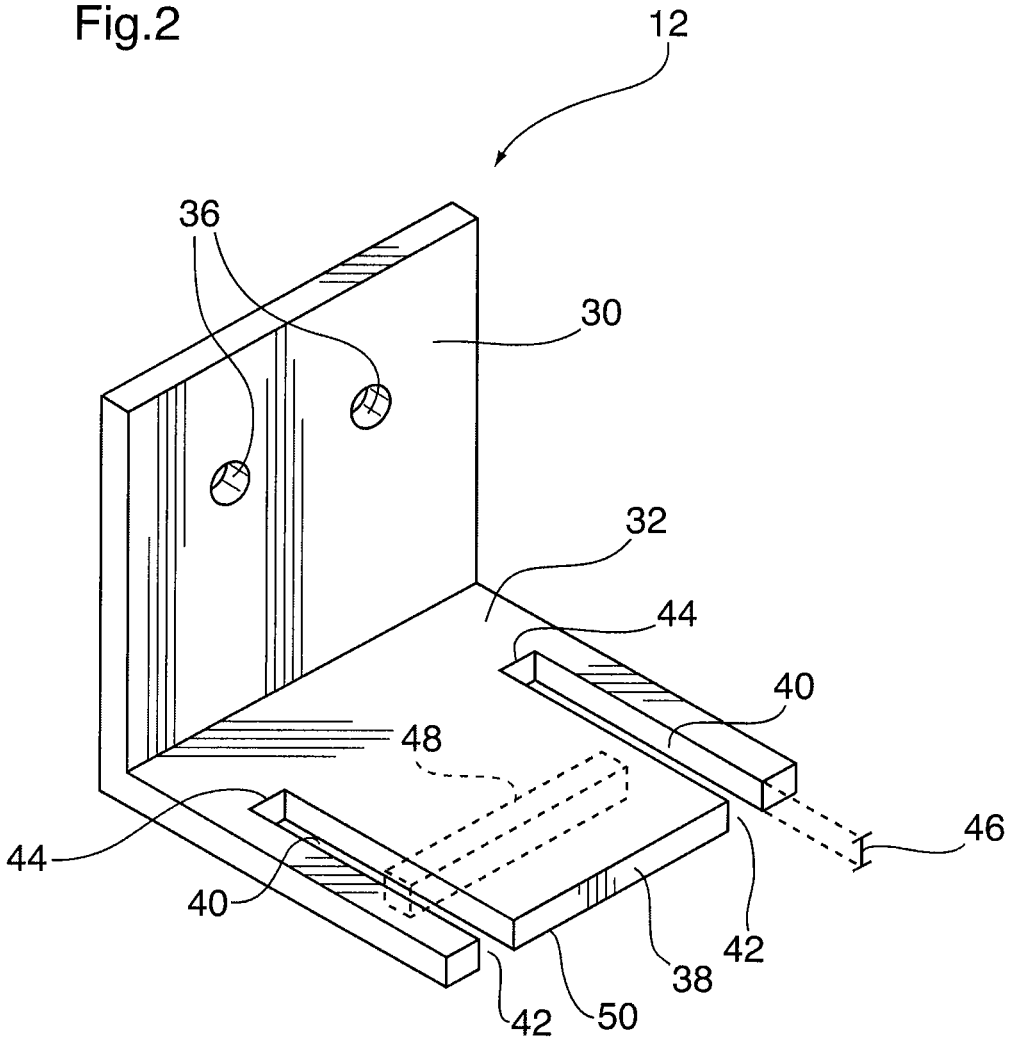
FIG. 2 is a perspective view of the support member of the break away connector system of FIG. 1.

The support member 12 exemplified in FIGS. 1 and 2 is an angle having a first section 30 and a second section 32. As exemplified, second section 32 may be substantially orthogonal to first section 30. As exemplified, first section 30 may be substantially vertical, and second section 32 may be substantially horizontal when installed onto a substantially vertical firewall, such as firewall 20 (FIG. 1).

In some cases, support member 12 is fixedly secured to firewall 20. When support member 12 is an angle, first section 30 may be fixedly securable to face 34 of firewall 20. FIG. 1 shows support member 12 fixedly coupled to face 34 of firewall 20.

As exemplified in FIG. 1, first section 30 is fixedly secured to face 34 of firewall 20 by attachment member 22. Attachment member 22 may pass through first section 30 of support member 12 and into the firewall 20, to attach the support member thereto. As illustrated, attachment member 22 may pass through support member 12, through gypsum board layer 26 and into masonry block 24. Preferably, attachment member 22 fixedly couples support member 12 to firewall 20. In some cases, attachment member 22 can be placed into uncured concrete that, once cured, will form at least part of firewall 20. Once firewall 20 cures, attachment member 22 is securably embedded into firewall 20. Preferably, as exemplified in FIG. 1, attachment member 22 is a bolt embedable into firewall 20. Alternatively, attachment member 22 may be drilled, screwed, or hammered into firewall 20 after the firewall has cured. Any means known in the building arts may be used. For example, attachment member 22 may comprise a screw, a high strength industrial adhesive, or the like.

As shown in FIG. 2, first section 30 of support member 12 may define at least one aperture 36 for receiving attachment member 22 therethrough, to couple support member 12 to firewall 20 (FIG. 1). In some embodiments, first section 30 defines a plurality of apertures 36 (FIG. 2), each is of which is capable of receiving attachment member 22 (FIG. 1) therethrough.

Figure 3:
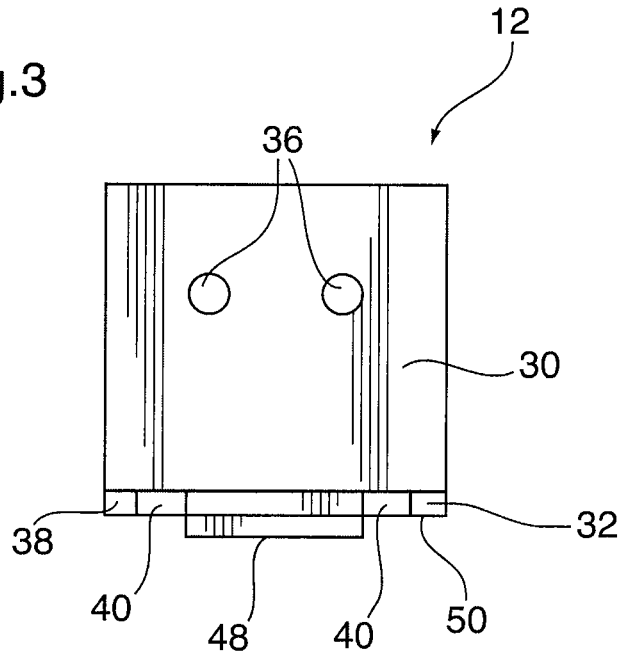
FIG. 3 is a front view of the support member of FIG. 2.
Figure 4:
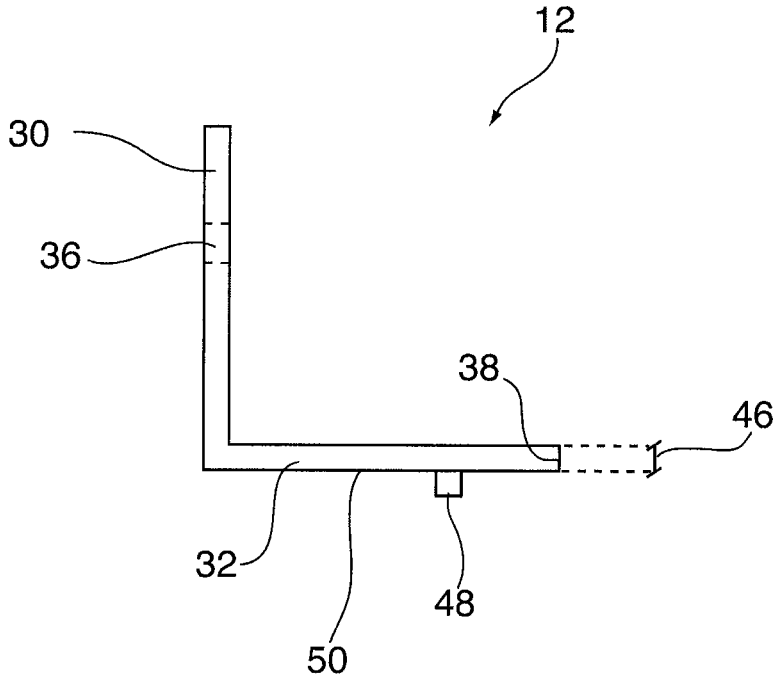
FIG. 4 is a side view of the support member of FIG. 2.
Figure 5:
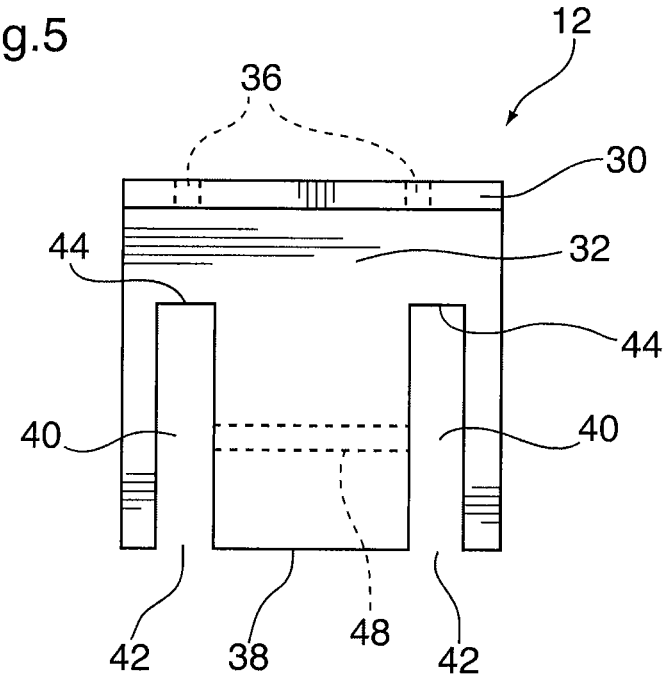
FIG. 5 is a plan view of the support member of FIG. 2.

FIGS. 3, 4, and 5 provide a front view, side view, and plan view, respectively, of the example support member 12 illustrated in FIG. 2.

The support member 12 exemplified in FIG. 2 has a disengagement end 38. Disengagement end 38 is located at the end of second section 32 that is distally located from first section 30. Support member 12 may have at least one channel 40. Each channel 40 has an open end 42 at disengagement end 38. Support member 12 may contain one channel 40 or a plurality of channels 40. Each channel 40 may be of elongate shape; however, it will be appreciated that channel 40 may have various geometries that provide an open end 42. As non-limiting examples, channel 40 may be rectangular, semi-circular, semi-elliptical, or have a box-shaped configuration with three equal wall-portions and a fourth open or partially open end. When multiple channels 40 have an elongate shape, they may extend substantially parallel to one another to facilitate the slidable release of securing member 18 (FIG. 1) from each channel 40. Each channel may be located in second section 32, as illustrated in FIG. 2.

As shown in FIG. 2, each channel 40 may have a closed end 44 that opposes open end 42 and extends entirely through the thickness dimension 46 of second section 32, as illustrated in FIG. 2.

In some embodiments, support member 12 comprises a support member engagement member 48 for mating with fusible member 14. As illustrated in FIG. 2, support member engagement member 48 may comprise a protrusion. In some cases, support member engagement member 48 comprises a protrusion which preferably extends downwardly from the bottom surface 50 of support member 12. Support member engagement member 48 may comprise a protrusion that extends at an angle to channel 40 of support member 12. Preferably, the elongate axis of the protrusion 48 extends substantially orthogonal to the elongate axis of each channel 40, as illustrated in FIG. 2.

In some embodiments, support member 12 is made of metal. As a non-limiting example, support member 12 may be made of steel. Support member 12 may also comprise at least one high melting-point alloy material such as tungsten or nickel. Any material known in the building arts may be used.

Figure 6:
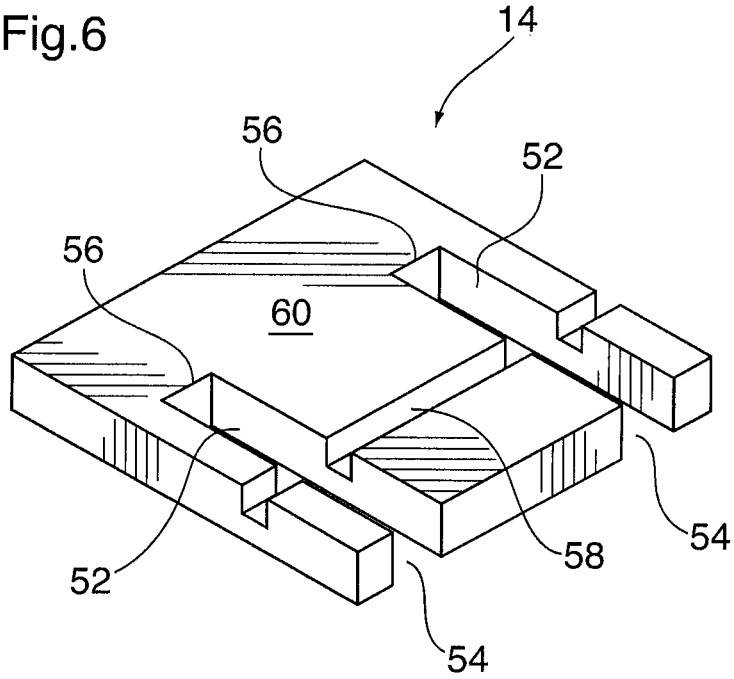
FIG. 6 is a perspective view of the fusible member of the break away connector system of FIG. 1.

FIG. 6 illustrates an example fusible member 14. As illustrated, fusible member 14 has at least one opening 52 therethrough and may have a plurality of openings 52. Preferably, at east one opening is provided for each channel 40 of support member 12.

Preferably, a least one opening 52 (FIG. 6) is alignable with a channel 40 of support member 12 (FIG. 2) so that securing member 18 may pass through both support member 12 and fusible member 14. Preferably, each opening 52 is alignable with a channel 40 of support. member 12. When an opening 52 of fusible member 14 (FIG. 6) is aligned with a channel 40 of support member 12 (FIG. 2), a passageway 57 is defined through the fusible member 14 and support member 12. As exemplified in FIG. 1, securing member 18 extends through passageway 57 defined by the support member 12 and fusible member 14. At least one securing member 18 is extendable through opening 52 (FIG. 6) of fusible member 14 and channel 40 (FIG. 2) of support member 12. One or more securing members 18 are extendable through each opening 52 (FIG. 6) and channel 40 (FIG. 2). Preferably, each securing member 18 extends transversely through second section 32 of support member 12.

Referring to FIG. 6, in some cases, an opening 52 is an open ended channel having an open end 54 and an opposing closed end 56. In some cases, opening 52, as an open ended channel, is alignable with channel 40 of support member 12 (FIG. 2). The dimensions of an opening 52 may be substantially similar to a channel 40 of support member 12 (FIG. 2). In such cases, when the support member 12 is brought into an abutting relationship with fusible member 14 (as shown in FIG. 1, for example), each channel 40 of support member 12 (FIG. 2) that has dimensions corresponding to an alignable opening 52 of fusible member 14 (FIG. 6) together form a single channel. In some cases, opening 52 comprises an enclosed aperture that does not have any open ends (not shown).

Fusible member 14 is made of a material that has a lower melting point than support member 12. Fusible member 14 is made of a material that is weakened by heat. In some embodiments, fusible member 14 is made of a plastic material. In some cases, fusible member 14 may be made of aluminum. Fusible member 14 may also comprise low-melting point alloy materials containing, for example, bismuth, tin, cadmium, zinc or indium.

As non-limiting examples, the fusible member 14 may be made of material that weakens by melting, shriveling, cracking, shattering, contracting, softening, buckling, burning, disintegrating or any combination thereof when subjected to sufficient heat. Preferably, fusible member 14 will weaken when it is subjected to heat above its melting point. Preferably, fusible member 14 has a melting point below the temperature generated by a typical fire within an interior space, such as interior space 28 illustrated in FIG. 1.

In some embodiments, as illustrated in FIG. 6, fusible member 14 comprises a fusible member engagement member 58 for mating with support member 12. Fusible member engagement member 58 may comprise a groove. The groove may be located in a top surface 60 of fusible member 14. When opening 52 of fusible member 14 is an open ended channel, fusible member engagement member 58 may comprise a groove that extends at an angle to the open ended channel. Preferably, the elongate axis of the groove extends substantially orthogonal to the elongate axis of the opening 52, as illustrated in FIG. 6.

Figure 7:
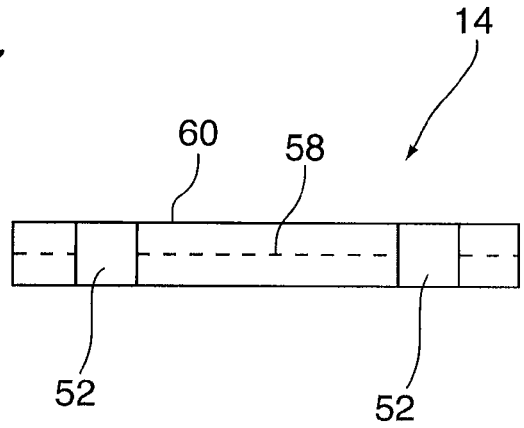
FIG. 7 is a front view of the fusible member of FIG. 6.
Figure 8:
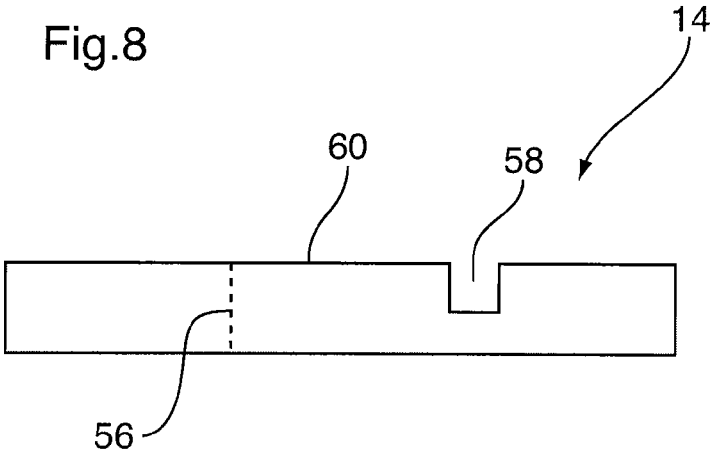
FIG. 8 is a side view of the fusible member of FIG. 6.
Figure 9:
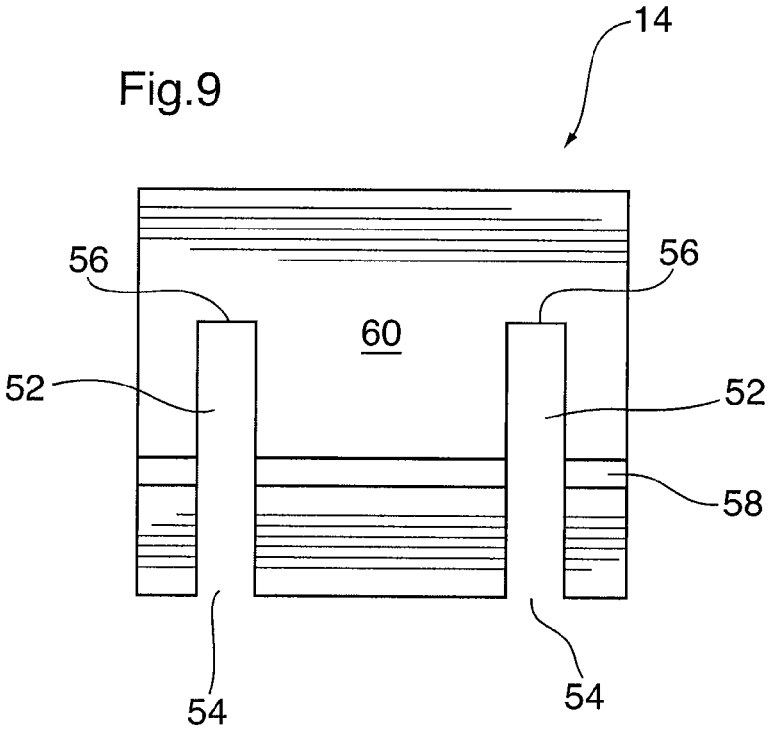
FIG. 9 is a plan view of the fusible member of FIG. 6.

FIGS. 7, 8 and 9 provide a front view, side view and plan view, respectively, of the fusible member 14 illustrated in FIG. 6.

Figure 10:
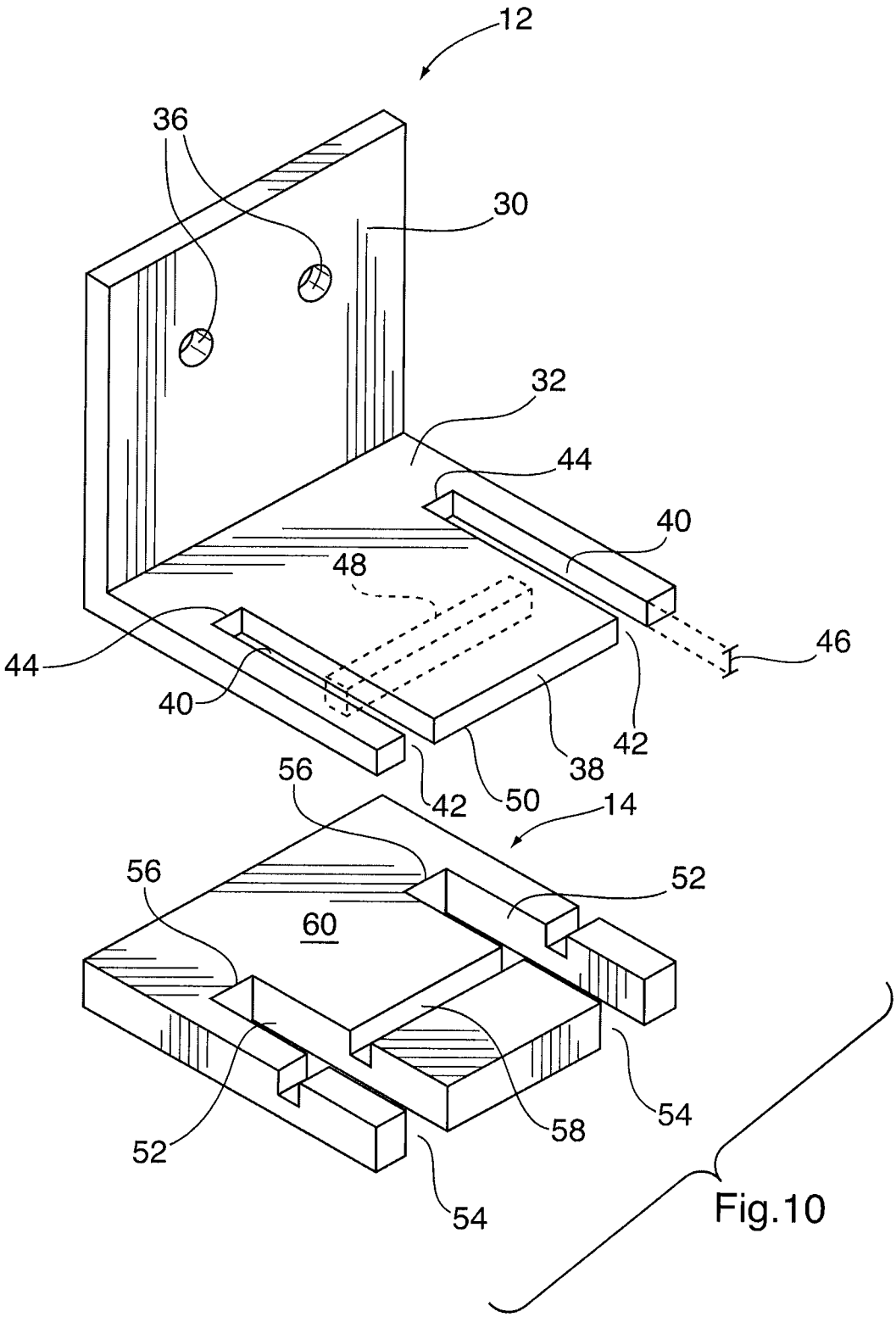
FIG. 10 is an exploded view of the break away connector system of FIG. 1.

FIG. 10 illustrates support member 12 and fusible member 14 in an unassembled configuration. When support member 12 and fusible member 14 are moved towards one another, fusible member 14 may be lockingly securable to support member 12. Support member 12 and fusible member 14 may have mating engagement members 48 and 58 for non-slidably positioning fusible member 14 to support member 12. Accordingly, as exemplified in FIG. 1, in the assembled state, the engagement members 48 and 58 may interengage one another to reduce relative movement between support member 12 and fusible member 14.

FIGS. 1 and 10 illustrate support member engagement member 48 as a protrusion and fusible member engagement member 58 as a groove. In an alternative embodiment, support member engagement member 48 comprises a groove for engaging fusible member engagement member 58, which is a protrusion. In some cases, a plurality of corresponding engagement members 48 and 58 may be provided. For example, other engagement members may be used such as a plurality of pins. Alternately, an adhesive or welding may be used.

As illustrated in FIG. 1, securing member 18 is extendable through both support member 12 and fusible member 14 to secure support member 12 to floor or ceiling 16. FIG. 1 illustrates the floor or ceiling 16 coupled to firewall 20 by breakaway connector 10 in the absence of a heat-producing event, such as a fire or explosion. As illustrated, securing member 18 extends through a channel 40 of support member 12 (FIG. 2) that is aligned with an opening 52 of abutting fusible member 14 (FIG. 6). Securing member 18 also extends through at least a portion of floor or ceiling 16. For example, securing member 18 may extend through a flange or central beam portion of floor or ceiling 16 in the event that the floor or ceiling is an I-beam. Preferably, floor or ceiling 16 has an alignable opening (not shown) for receiving securing member 18 therethrough. Any means to attach attachment member 18 to the floor or ceiling may be used.

As exemplified in FIG. 1, securing member 18 is operable to compress floor or ceiling 16, support member 12 and fusible member 14 inwardly towards one another. In the embodiment shown in FIG. 1, securing member 18 comprises a bolt 62 having two nuts 68. As exemplified, bolt 62 has a first end portion 64 and an opposing second end portion 66. Each end portion may have a nut 68 mounted thereon. Preferably, one nut 68 is fixedly attached to one of first end portion 64 and second end portion 66, while the other nut 68 is adjustably mounted to the other end portion of bolt 62. The adjustably mounted nut 68 may have internal threads that mate with external threads on the corresponding end portion of bolt 62. Alternatively, both nuts 68 may be adjustably mounted to corresponding end portions 64 and 66 of bolt 62.

Each nut 68 engages an outer surface of at least one of the floor or ceiling 16, and one of support member 12 and fusible member 14. Additional layers of material may be added to the floor or ceiling 16, support member 12 and fusible member 14 combination. If additional layers are present, each nut may engage the outermost surface of each outermost layer. In the example provided in FIG. 1, securing member 18 extends through, in series from top to bottom, floor or ceiling 16, support member 12 and fusible member 14. In this example, one nut 68 engages an upper surface 70 of an upper flange of the floor or ceiling 16, which may be an I-beam, for example. Alternatively, nut 68 could engage upper surface 72 of the lower flange of the illustrated I-beam that comprises floor or ceiling 16. In the illustrated example, the other nut 68 engages the lower surface 74 of fusible member 14. When at least one of the two nuts 68 are tightened, the two nuts 68 operate to compress the floor or ceiling 16, support member 18 and fusible member 14 together. Preferably, these three elements are compressed into abutting relationship with one another. In some cases, the three elements are compressed into an abutting relationship with one another such that the mating surfaces for the elements are in substantially flush relationship with one another. The compressive force created by securing member 18 secures floor or ceiling 16 and fusible member 14 to support member 12. Preferably, floor or ceiling 16 and fusible member 14 are secured to second section 32 of support member 12. Support member 12 is connectable to firewall 20. Preferably, first section 30 of support member 12 is connectable to firewall 20. Therefore, floor or ceiling 16 is securable to firewall 20 by support member 12. In the absence of heat, the combination of support member 12 and fusible member 14 couples floor or ceiling 16 to firewall 20.

It will be appreciated that FIG. 1 provides an example embodiment in which the following elements are coupled together in the following order, from top to bottom: floor or ceiling 16, support member 12 and fusible member 14. Preferably, support member 12 and fusible member 14 are in abutting relationship with one another. In this case, support member engagement member 48 and fusible engagement member 58 are engagable with one another. However, it will be appreciated that the arrangement of elements from top to bottom, for floor or ceiling 16, support member 12 and fusible member 14 may occur in any available permutation of sequential orders. As a non-limiting example, support member 12 and fusible member 14 may be separated from one another by floor or ceiling 16. In this embodiment, the compressive force generated by securing member 18 would be relied upon to secure support member 12 and fusible member 14 together in the absence of the securing functionality of engagement members 48 and 58.

In some cases, at least one of floor or ceiling 16, support member 12 and fusible member 14 may be offset from the horizontal such that the members are not necessarily coupled together in a linear, top-to-bottom relationship.

It will also be appreciated that additional layers of material may be inserted between at least one of the floor or ceiling 16, support member 12 and fusible member 14. As a non-limiting example, break away connector system 10 may comprise multiple fusible members.

It is beneficial for floor or ceiling 16 to be releasable from firewall 20 in the event of a fire or a heat-inducing explosion. If, for example, floor or ceiling 16 catches fire, it is beneficial for floor or ceiling 16 to release from firewall 20. Once the floor or ceiling 16 is disengaged from the firewall 20, the floor or ceiling 16 is able to fall away from firewall 20. The motion of disengaged floor or ceiling 16 may have a downward component due to the gravitational forces acting on floor or ceiling 16.

In some cases, as floor or ceiling 16 is heated by fire, it will deflect downwardly. When a floor or ceiling 16 is uniformly heated by fire, this downward deflection will typically be most prevalent at the mid-span of a joist or beam of floor or ceiling 16. Any sagging of floor or ceiling 16 will exert a force on break away connector system 10 and firewall 20 inward and downward towards interior space 28. In this case, when floor or ceiling 16 is released and separated from firewall 20, it may fall inward and downward into interior space 28, away from firewall 20. This will serve to move the floor or ceiling 16, which is on fire, away from firewall 20. When a heat source (e.g., floor or ceiling 16, which is on fire) is free to fall away from firewall 20, the total heat experienced by the firewall will be reduced. Therefore, the releasable engagement between firewall 20 and floor or ceiling 16 may serve to space ignited structural elements from firewall 20. This spaced relationship increases the duration during which the firewall can remain in tact. As a result, firefighters may be provided with sufficient time to contain the fire to interior space 28. In some cases, occupants in an adjacent room/structure may be provided with sufficient time to escape before the firewall is compromised and the fire spreads to the adjacent space.

Figure 11:
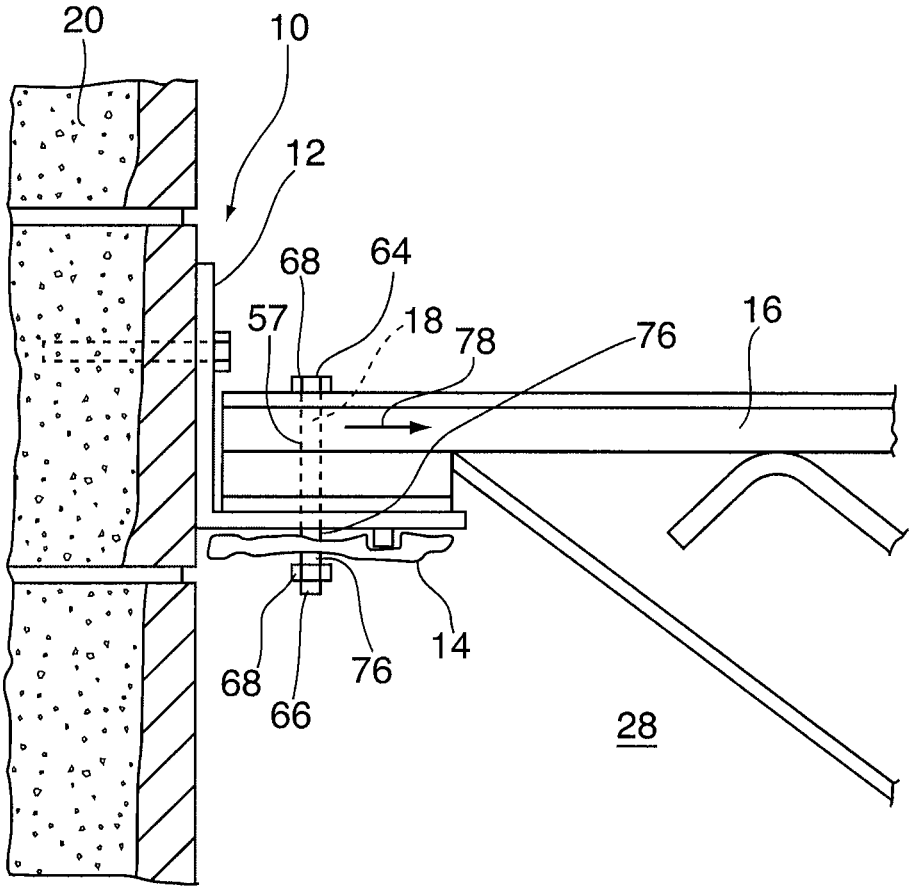
FIG. 11 is a side view of the of break away connector system of FIG. 1 when the fusible member is weakened by heat.

FIG. 11 exemplifies break away connector system 10 after it has been subjected to a heat-producing event, such as a fire or explosion. Support member 12 is configured for slidable release of the floor or ceiling 16 from support member 12 when fusible member 14 is weakened by heat. Since the fusible member 14 has a lower melting point than support member 12, fusible member 14 is weakened while support member 12 remains in tact. As non-limiting examples, fusible member 14 material may melt, shrivel, crack, shatter, contract, soften, buckle, burn or disintegrate when subjected to heat.

FIG. 11 exemplifies an example fusible member 14 that has melted and shriveled under the influence of fire. Such a deformation may occur when fusible member 14 is made of plastic, for example. In the illustrated example, when the fusible member 14 weakens, the location of nut 68 on second end portion 66 of bolt 62 remains stationary. This creates at least one gap 76 between at least two of the floor or ceiling 16, support member 12 and fusible member 14. FIG. 1 illustrates gaps 76 located in the span between support member 12 and second portion 66 of bolt 62. In the illustrated embodiment, due to the presence of gaps 76, bolt 62 no longer supplies the compressive force necessary to retain securing member 18 to support member 12. As a result, securing member 18 may slide into interior space 28, in a generally inward direction indicated by arrow 78, as illustrated in FIG. 11.

In some embodiments, the weakening of fusible member 14 will cause support member engagement member 48 to disengage from fusible member engagement member 58, as shown in FIG. 11, for example. As an example, fusible member engagement member 58 may melt away from its mating contact with support member engagement 48 when fusible member 14 is subjected to heat. In the absence of this mating engagement, the outward force supplied by the mating engagement (which may be directed horizontally outward away from interior space 28) is removed. When floor or ceiling 16 disengages from support member 12 it is free to fall away from the remainder of break away connector system 10.

The release of floor or ceiling 16 from support member 12 may be caused by the disengagement of engagement members 48 and 58, the removal of the compressive force supplied by securing member 18, or a combination thereof or sufficient weakening of the fusible member to permit relative movement of the floor or ceiling and the support member.

Figure 12:
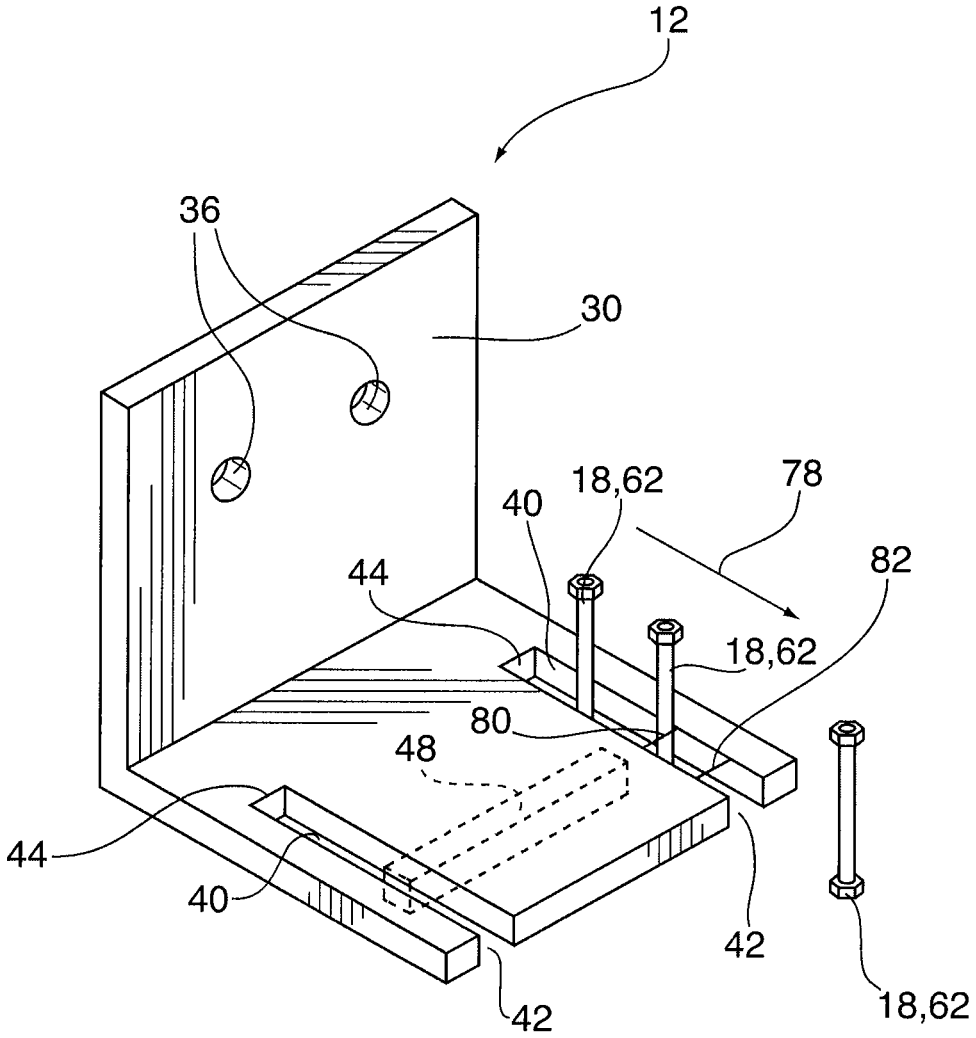
FIG. 12 is a perspective view of the support member of FIG. 2 showing a securing member extending through the support member and sliding through different positions relative to a channel of the support member.

As shown in FIG. 12, when fusible member 14 is weakened by heat, the securing member 18 is free to slide through channel 40 of support member 12. FIG. 12 illustrates the same securing member 18 at three different moments in time. Once fusible member 14 is weakened by heat (not shown in FIG. 12, but illustrated in FIG. 11), securing member 18 is free to slide though channel 40. Securing member 18 is free to slide away from closed end 44 toward open end 42 of channel 40, as indicated by the three example positions of securing member 18, 18' and 18" that are progressively further away from closed end 44. When securing member 18 passes through open end 42 (exemplified by securing member 18"), securing member 18 is slidably disengaged from support member 12.

Each securing member 18 that extends through support member 12 and fusible member 14 (FIG. 6) have a securing member width dimension 80 that is oriented parallel to width 82 of each corresponding channel 40 of support member 12. As illustrated in FIG. 12, when securing member 18 is a bolt 62, securing member width dimension 80 is the diameter of bolt 62 that passes through channel 40 of support member 12. Securing member width dimension 80 is preferably less than width 82 of each corresponding channel 40.

Figure 13:
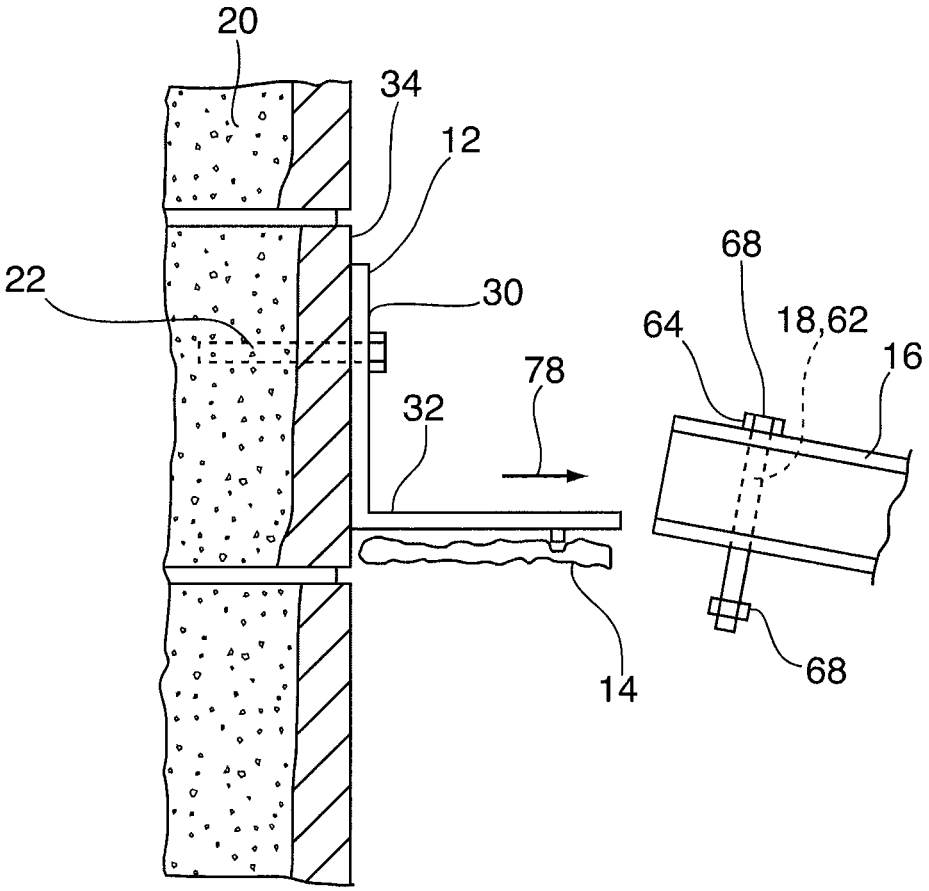
FIG. 13 is a side view of a floor having been released from the break away connector system of FIG. 1 after the fusible member has been weakened by heat.

As exemplified in FIG. 13, when securing member 18 is slidably released from support member 12, floor or ceiling 16 is slidably released from support member 12. When break away connector system 10 is subject to heat greater than the melting point of fusible member 14, but less than the melting point of support member 12, securing member 18 and floor or ceiling 16 is slidably releasable from support member 12. This occurs because fusible member 14 is weakened while support member 12 remains in tact. (See for example FIG. 13).

In some cases, as illustrated in FIG. 13, fusible member 14 is free to fall in a generally downward direction under gravitational forces after securing member 18 has been slidably released from support member 12. In this case, fusible member 14 is free to fall away from support member 12, which may remain affixed to firewall 20.

In some cases, the support member 12 is fixedly secured to firewall 20 when floor or ceiling 16 is slidably disengagable from support member 12, as shown in FIG. 13. When securing member 18 and floor or ceiling 16 disengage from firewall 20 due to the weakening of fusible member 14, support member 12 may remain fixedly secured to face 34 of firewall 20. Attachment member 22 may provide this fixedly secured relationship.

Although securing member 18 disengages from support member 12, the securing member may remain attached to the floor or ceiling 16, as shown in FIG. 13. In this case, both the floor or ceiling 16 and securing member 18 slidably release from support member 12. Floor or ceiling 16 and securing member 18 may disengage from support member 12 as a unit.

If fusible member opening 52 has an open end 54 (FIG. 6), securing member 18 (FIG. 1) may also slidably releasable from fusible member 14 (FIG. 1). Securing member 18 may release from the remainder of fusible member 14 that is left in tact after being subjected to heat by sliding through open end 54 of opening 52.

If the fusible member opening 52 does not have an open end, then the securing member may break through the portion of fusible member 14 that impedes the slidable release of securing member 18. In some cases, if the fusible member 52 does not have an open end, the securing member may remain within opening 52 of weakened fusible member 14 when securing member 18 is slidably released from the support member 12. In this case, the weakening of fusible member 14 slidably disengages both the weakened fusible member 14 and securing member 18, as a coupled unit, from support member 12. As a non-limiting example, this type of release may occur when fusible member 14 shrivels and contracts when subjected to heat above its melting point. When this type of release occurs, both fusible member 14 and securing member 18 are disengaged from support member 12 and may fall away from support member 12 coupled to one another.

It will be appreciated that securing member 18 may comprise structural elements other than a nut and bolt arrangement. For example, securing member 18 may comprise a screw. Such a screw may have external threads configured to mate with engagable threading located on floor or ceiling 16, for example (not shown). Alternatively, securing member 18 may comprise an external clamp for engaging at least two of the outermost surfaces of the abutting floor or ceiling 16, support member 12 and fusible member 14 combination to compress these elements together (not shown).

Figure 14:
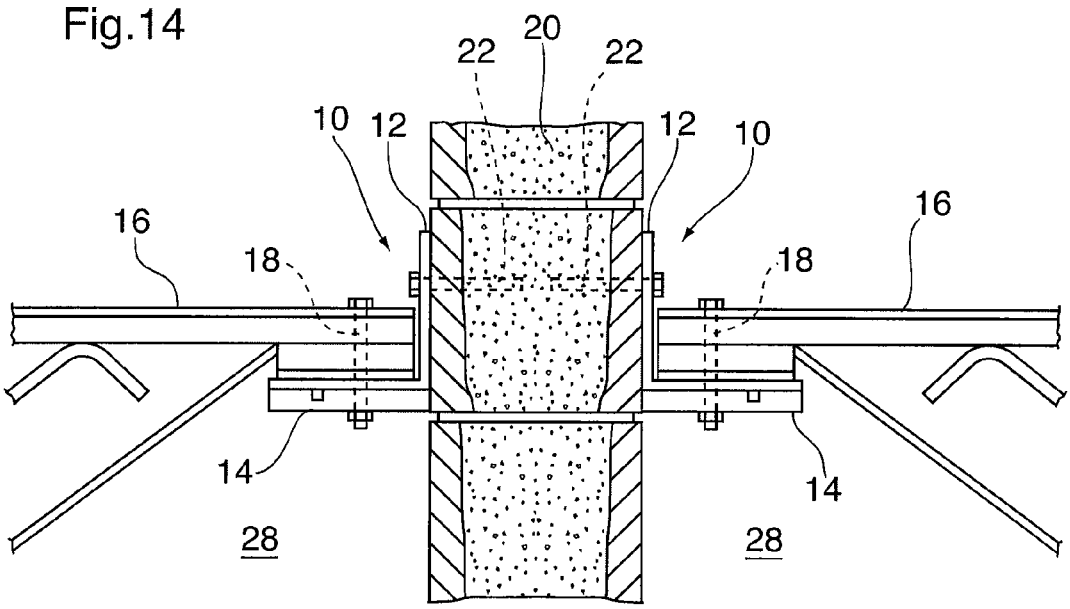
FIG. 14 is a side view of two of the break away connector systems illustrated in FIG. 1, as individually coupled to a firewall.

FIG. 14 illustrates a plurality of break away connectors 10 in the assembled state, secured to firewall 20.

Figure 15:
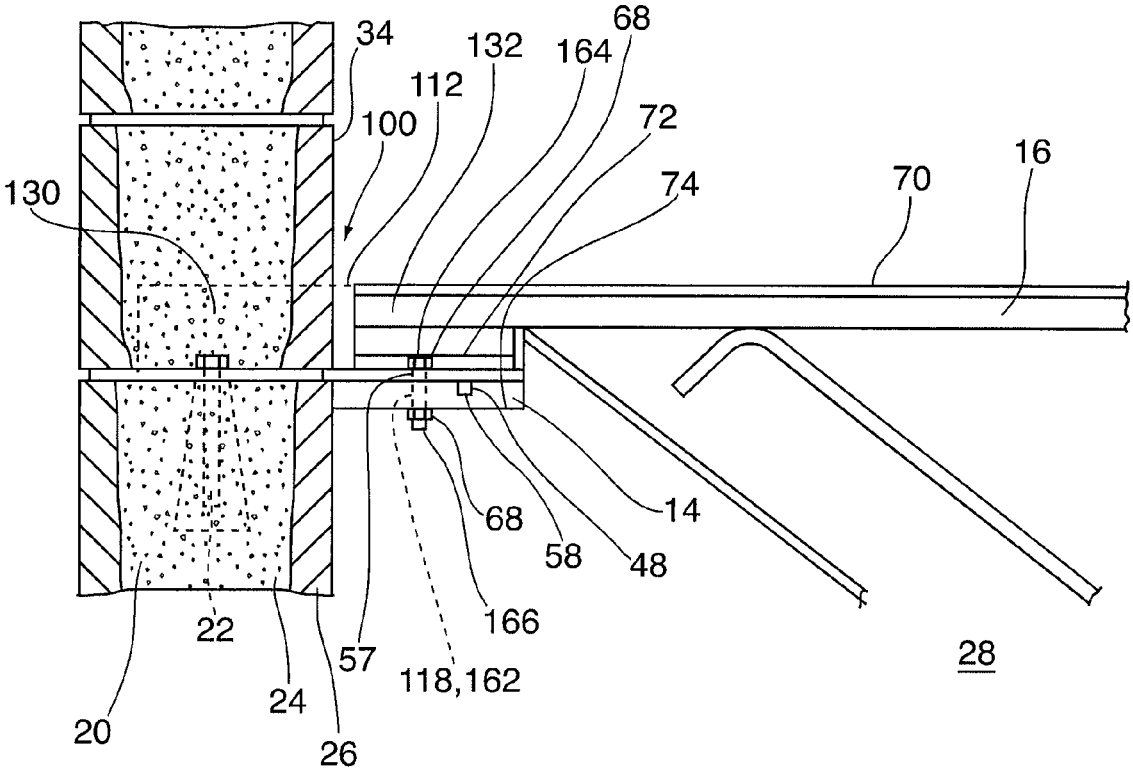
FIG. 15 is a side view of a break away connector system in accordance with an alternate embodiment of the invention, shown in an assembled state.

Referring to FIG. 15, there is illustrated an alternative embodiment of the break away connector system 10 illustrated in FIG. 1. The break away connector system 100 shown in FIG. 15 is similar to the example embodiment shown in FIG. 1, but includes a modified support member 112 having modified first section 130 and second section 132. First section 130 may have one or more apertures 136 therethough. Break away connector system 100 may also comprise a modified attachment member 122 and securing member 118. For convenience, description of elements or components that are common to the two embodiments of break away connector system 10 and 100 will not be repeated; however, some differences may be highlighted or contrasted. Further description of like or analogous elements illustrated in FIGS. 15-20 is provided above with reference to FIGS. 1-14.

Figure 16:
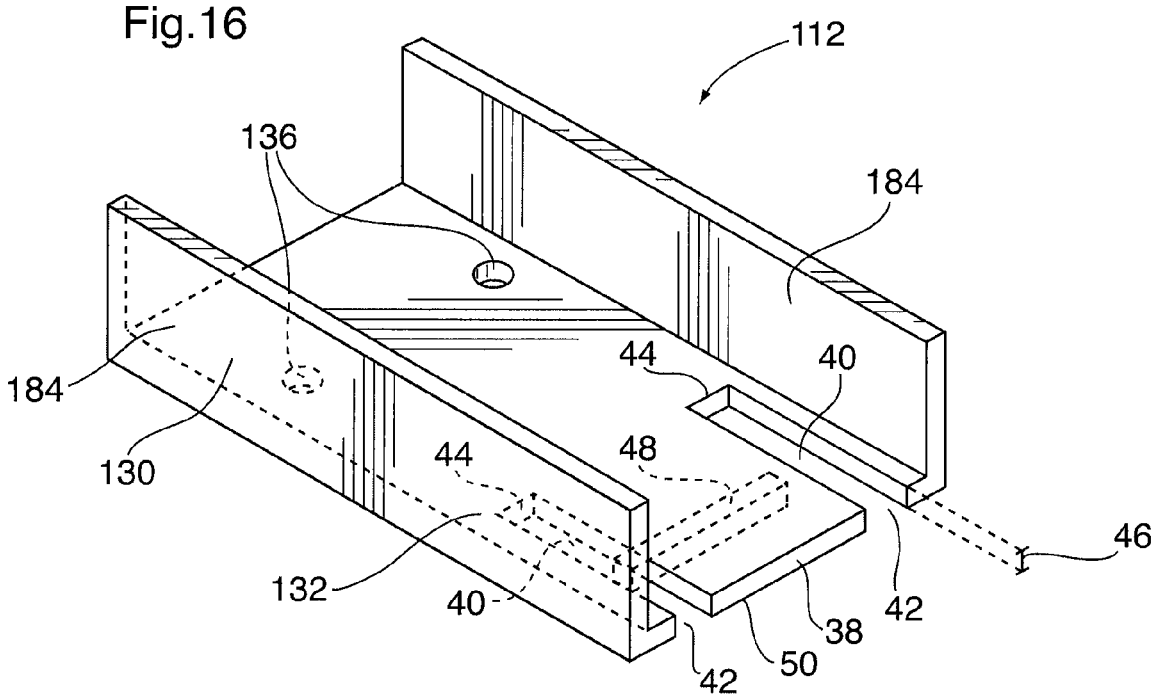
FIG. 16 is a perspective view of the support member of the break away connector system of FIG. 15.

As exemplified in FIG. 16, support member 112 may comprise a structural member defining a U-shaped structural channel. In some cases, first section 130 is substantially parallel to second section 132 of support member 112. Preferably, first section 130 and second section 132 are integrally connected to one another (integrally formed) to form a U-shaped channel. A portion of the floor or ceiling 16 may be received within the U-shaped channel. In some cases, a portion of the floor or ceiling 16 is receivable between a pair opposing sidewalls 184 of U-shaped support member 112. Preferably, pair of opposing walls 184 extends along both first section 130 and second section 132 of support member 112. In some cases, opposing sidewalls 184 are substantially vertical and may function to stabilize a portion of floor or ceiling 16 within support member 112.

In the example illustrated in FIG. 16, first section 130 of support member 112 has at least one aperture therethrough for receiving a corresponding attachment member 122 for securing support member 112 to firewall 20 (see FIG. 15).

In the example illustrated in FIG. 15, securing member 118 is a bolt 162. As illustrated, nut 68 at first end portion 164 of the bolt engages a lower flange upper surface 72 of floor or ceiling 16, as opposed to upper flange upper surface 70 of floor or ceiling 16, as illustrated in the FIG. 1. As a result, securing member 118 illustrated in FIG. 15 may be shorter than securing member 18 illustrated in FIG. 1. In the FIG. 15 example, lower flange upper surface 72 may be the upper surface of a lower flange of an I-beam of floor of ceiling 16, for example. In the illustrated example, second end portion 166 of bolt 162 engages the lower surface 74 of fusible member 14. As illustrated, securing member 118 may compress floor or ceiling 16, support member 112 and fusible member 14 together to retain floor or ceiling 16 to support member 112 in the assembled state.

Figure 17:
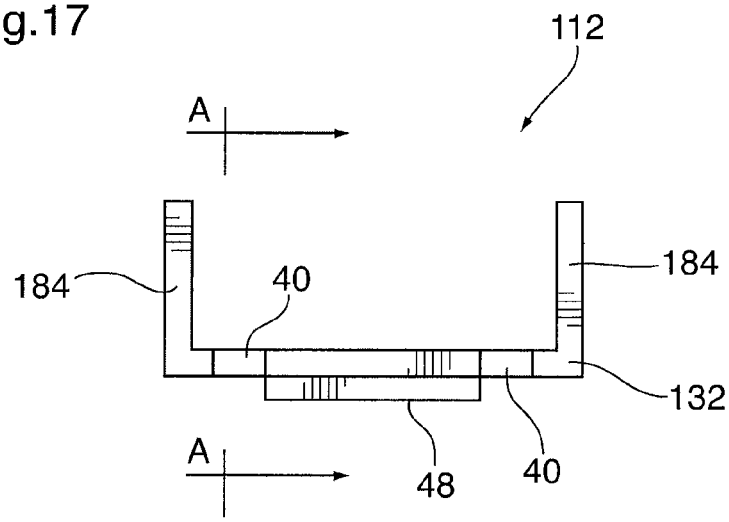
FIG. 17 is a front view of the support member of FIG. 16.
Figure 18:
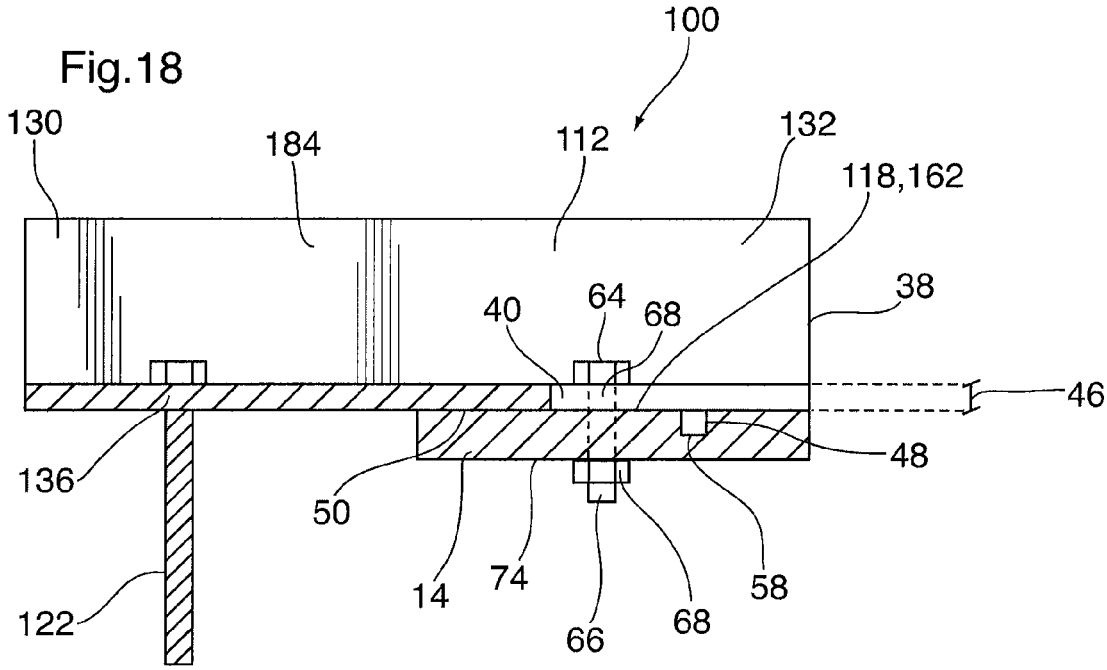
FIG. 18 is a cut-away side view of the break away connector system of FIG. 16, taken along line A-A in FIG. 17.
Figure 19:
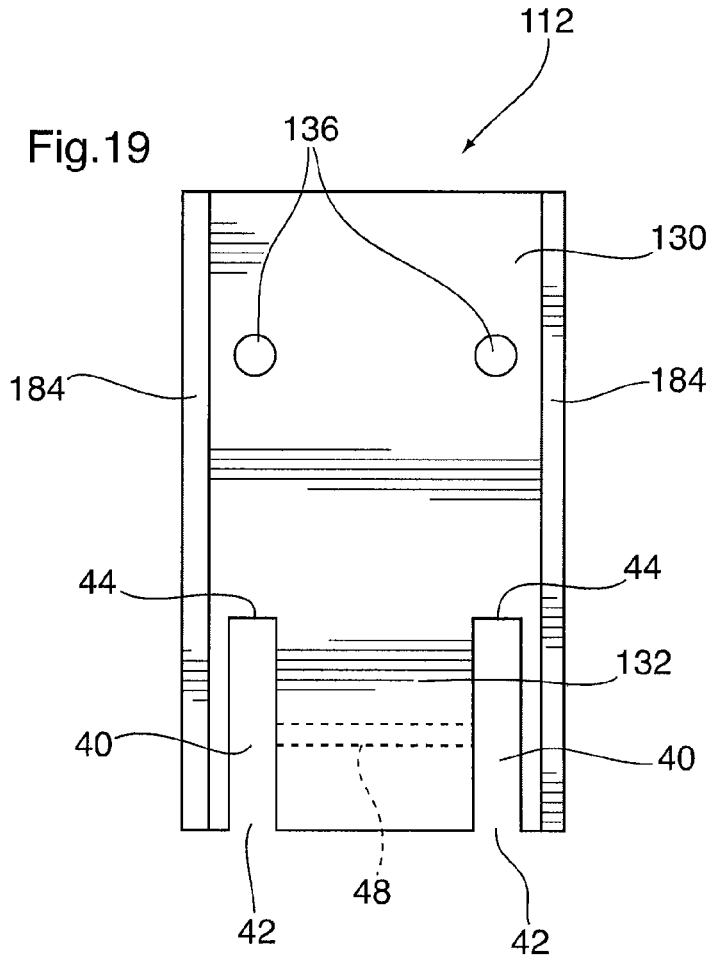
FIG. 19 is a plan view of the support member of FIG. 16.

FIGS. 17, 18 and 19 provide a front view, side view, and plan view, respectively, of the support member 112 illustrated in FIG. 16. FIG. 18 provides a sectional view taken along line A-A of support member 112 illustrated in FIG. 17. FIG. 18 illustrates attachment member 122, securing member 118 and fusible member 14 coupled to support member 112.

As exemplified in FIG. 15, support member 112 is embedded into firewall 20, as opposed to being securable to the face 34 of firewall 20 (as illustrated in FIG. 1). First section 130 of support member 112 is embedded into firewall 20 and second section 132 extends from first section 130. As illustrated, when support member 112 is coupled to firewall 20, second section 132 remains exposed. Optional attachment member 122 may be a bolt 162, screwor the like located within firewall 20. Preferably, first section 130 of support member 112 is placed within the area to be occupied by firewall 20 prior to firewall 20 being formed. For example, if firewall 20 comprises poured concrete, first section 130 may be placed in the area to be occupied by firewall 20 prior to the concrete being poured. Alternately, it may be placed on top of a concrete block before the next concrete block is placed thereon. Accordingly, attachment member 122 may secure first section 130 to a pre-existing portion of firewall 20 (i.e. a concrete block or a previously poured portion). Once the concrete is poured, first section 130 may be securely cured into firewall 20.

Preferably, second section 132 that is exposed from firewall 120 has channel 40 disposed therein (see FIG. 16). At least one securing member 118 (FIG. 15) is extendable through each channel 40 of support member 12 (FIG. 16), for coupling the floor or ceiling 16 to support member 112 (as shown in FIG. 15).

Since first section 130 of support member 112 may be embeddable into firewall 20, support member 112 may be fixedly secured to firewall 20 when the floor or ceiling 16 is disengagable from the support member.

Although support member 112 is illustrated as a U-shaped channel in FIG. 16, support member 112 may also comprise, for example, a plate, beam, or C-shaped channel that is embeddable into firewall 20 (FIG. 15).

Figure 20:
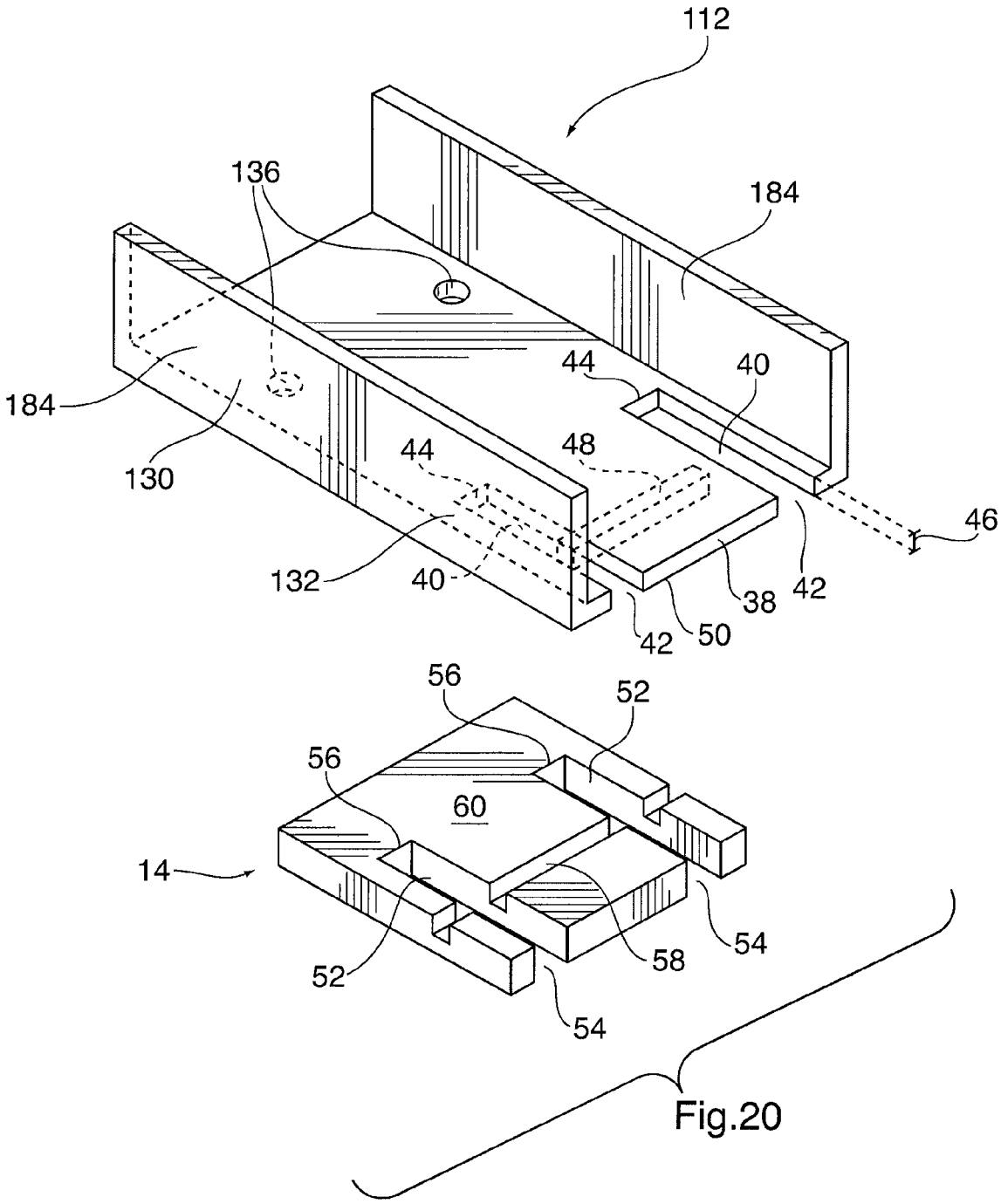
FIG. 20 is an exploded view of the break away connector system of FIG. 16.

FIG. 20 illustrates support member 112 and fusible member 14 in an unassembled configuration. It should be appreciated that when the two components are moved towards one another into the assembled state, as illustrated in FIG. 15, the engagement members 48 and 58 interengage one another to reduce relative movement between support member 112 and fusible member 14.

A further embodiment of the invention relates to a method of constructing a firewall connection system which may utilize break away connector system 10 and/or 100. For brevity, the description of previously discussed figures is not repeated Referring to FIGS. 1 and 15, first section (30, 130) of support member (12, 112) is secured to a first structural member. The first structural member may be a firewall 20. First section 30 may be fixedly attached to a face 34 of firewall 20, as shown in FIG. 1. Alternatively, first section 130 is embeddable into firewall 20, as shown in FIG. 15.

Section portion (32, 132) of support member (12, 112) is secured to a second structural member. The second structural member may be floor or ceiling 16. Second portion (32, 132)

may be secured to the second structural member by passing at least one securing member (18, 118) through second portion (32, 132) of support member (12, 112) and fusible member 14 and into the second structural member.

It will be appreciated that support member (12, 112) may be secured to the first structural member prior to second section (32, 132) being secured to the second structural member, or visa versa. Preferably, first section (30, 130) is secured to the first structural member before second section (32, 132) is secured to the second structural member. This particular order is advantageous in some cases. For example, when the first section (30, 130) is installed first, exposed second section (32, 132) provides a surface upon which to support the floor or ceiling 16 against gravitational forces while second section (32, 132) is secured to the floor or ceiling.

As exemplified in FIGS. 2 and 16, support member (12, 112) has at least one open ended channel. Each channel 40 has an open end 42. Second section (32, 132) may be secured to the second structural member (such as floor or ceiling 16 shown in FIGS. 1 and 15) by passing at least one securing member (18, 118) (shown in FIGS. 1 and 15) through at least one open ended channel 40 of support member (12, 112) and through at least one opening 52 of fusible member 14.

In some cases, the method comprises positioning the fusible member 14 in an abutting relationship with support member 12 or 112, as shown in FIGS. 1 and 15, respectively. In some cases, abutting surfaces of support member (12, 112) and fusible member 14 are brought into substantially flush relationship with one another.

In some cases, the method comprises interengaging the support member (12, 112) and the fusible member 14, shown in FIGS. 1 and 15. As discussed above, support member engagement member 48 and fusible member engagement member 58 are operable to interengage, and in some cases lockingly secure, support member (12, 112) and fusible member 14 to one another.

Referring to FIGS. 1 and 15, in some cases, securing first section (30, 130) of support member (12, 112) to the first structural member 20 comprises fixedly securing first section (30, 130) so that support member (12, 112) is fixedly secured to the first structural member 20 when the second structural member 16 is disengagable from support member (12, 112).

In some cases, securing member (18, 118) is secured to the second member 16 after securing member (18, 118) is passed into the second structural member. Preferably, securing member (18, 118) is secured to the second structural member such that securing member (18, 118) remains attached to the second structural member when the fusible member 14 is weakened by heat.

What has been described above has been intended illustrative and non-limiting and it will be understood by persons skilled in the art that other variances and modifications may be made without departing from the scope of the disclosure as defined in the claims appended hereto.

The invention claimed is:

1. A break away connector system for a firewall comprising:

a) a support member, the support member having a first portion defining an anchor for connection to the firewall, and a second portion defining a seat upon which to secure a floor or ceiling member, whereby the support member carries the static load of the floor or ceiling member into the firewall;

at least one securement by which the support member is connected to the floor or ceiling member; and, c) a fusible member having a lower melting point than the support member, the floor or ceiling member being slidably releasable from the support member when the fusible member is weakened by heat and a translational force is applied to the floor or ceiling member.

2. The break away connector system as claimed in claim 1 wherein the support member has a disengagement end and at least one channel that has an open end at the disengagement end.

3. The break away connector system as claimed in claim 2 wherein the fusible member has at least one opening therethrough that is alignable with the channel of the support member whereby the at least one securing member is extendable through both the support member and the fusible member to secure the support member to the floor or ceiling.

4. The break away connector system as claimed in claim 3 wherein the at least one opening of the fusible member is an open ended channel that is alignable with the channel of the support member.

5. The break away connector system as claimed in claim 3 wherein the support member is an angle having a first section fixedly securable to a face of the firewall and having a second section substantially orthogonal to the first section, the second section having the at least one channel of the support member.

6. The break away connector system as claimed in claim 3 wherein the support member has a first section embedable into the firewall and a second section extending from the first section, the second section having the at least one channel of the support member.

7. The break away connector system as claimed in claim 1 wherein the fusible member is lockingly securable to the support member.

8. The break away connector system as claimed in claim 7 wherein the support member and the fusible member have mating engagement members.

9. The break away connector system as claimed in claim 8 wherein the engagement member of the support member comprises a protrusion and the engagement member of the fusible member comprises a groove.

10. The break away connector system as claimed in claim 9 wherein the fusible member comprises an opening that is an open ended channel and the groove extends at an angle to the opening of the fusible member.

11. The break away connector system as claimed in claim 1 wherein the at least one securing member is extendable through both the support member and the fusible member to secure the support member to the floor or ceiling and the support member is configured for slidable release of the floor or ceiling from the support member with the at least one securing member attached to the floor or ceiling when the fusible member is weakened by heat.

12. The break away connector system as claimed in claim 1 wherein the support member is fixedly secured to the firewall when the floor or ceiling is slidably disengagable from the support member.

13. The break away connector system as claimed in claim 1 wherein the support member is made of metal.

14. The break away connector system as claimed in claim 13 wherein the fusible member is made of plastic.

15. A method of constructing a firewall connection system, said method comprising:

a) providing a support member and a fusible member, the support member having a first portion and a second portion, and at least one securing member, the at least one securing member being slidably removable from the support member when the fusible member is weakened by heat;

b) securing the first portion of the support member to the firewall so that the second portion of the support member stands outwardly away from the firewall;

c) placing an end of a floor or ceiling beam upon the second portion of the support member such that the static load of the floor or ceiling beam is carried by the support member; and, d) securing the second portion of the support member to the floor or ceiling beam by passing the at least one securing member through the second portion of the support member and the fusible member and into the floor or ceiling beam.

16. The method of claim 15 wherein the second portion of the support member has at least one open ended channel and step (d) comprises passing the at least one securing member through the at least one open ended channel of the support member.

17. The method of claim 15 wherein the fusible member has at least one opening and step (c) comprises passing the at least one securing member through the at least one opening of the fusible member.

18. The method of claim 17 further comprising positioning the fusible member in an abutting relationship with the support member.

19. The method of claim 15 further comprising interengaging the support member and the fusible member.

20. A break away connector system for a firewall comprising:

a) a support member connectable to the firewall for securing a floor or ceiling to the firewall, the support member being connectable to the floor or ceiling by at least one securing member; and, b) a fusible member having a lower melting point than the support member;

the support member is configured for slidable release of the floor or ceiling from the support member when the fusible member is weakened by heat;

the fusible member is lockingly securable to the support member;

the support member and the fusible member have mating engagement members; and the engagement member of the support member comprises a protrusion and the engagement member of the fusible member comprises a groove.

21. The break away connector system as claimed in claim 20 wherein the fusible member comprises an opening that is an open ended channel and the groove extends at an angle to the opening of the fusible member.

22. A break away connector system for a firewall comprising:

a) a support member connectable to the firewall for securing a floor or ceiling to the firewall, the support member being connectable to the floor or ceiling by at least one securing member; and, b) a fusible member having a lower melting point than the support member;

the support member is configured for slidable release of the floor or ceiling from the support member when the fusible member is weakened by heat; and the support member has a disengagement end and at least one channel that has an open end at the disengagement end.

23. The break away connector system of claim 22 wherein the fusible member has at least one opening therethrough that is alignable with the channel of the support member whereby the at least one securing member is extendable through both the support member and the fusible member to secure the support member to the floor or ceiling.

24. The break away connector system as claimed in claim 23 wherein the support member is an angle having a first section fixedly securable to a face of the firewall and having a second section substantially orthogonal to the first section, the second section having the at least one channel of the support member.

25. The break away connector system as claimed in claim 23 wherein the support member has a first section embedable into the firewall and a second section extending from the first section, the second section having the at least one channel of the support member.

26. The break away connector system as claimed in claim 23 wherein the at least one opening of the fusible member is an open ended channel that is alignable with the channel of the support member.

27. The break away connector system as claimed in claim 22 wherein the fusible member is lockingly securable to the support member.

28. The break away connector system as claimed in claim 27 wherein the support member and the fusible member have mating engagement members.

29. The break away connector system as claimed in claim 28 wherein the engagement member of the support member comprises a protrusion and the engagement member of the fusible member comprises a groove.

30. The break away connector system as claimed in claim 29 wherein the fusible member comprises an opening that is an open ended channel and the groove extends at an angle to the opening of the fusible member.

31. The break away connector system as claimed in claim 22 wherein the at least one securing member is extendable through both the support member and the fusible member to secure the support member to the floor or ceiling and the support member is configured for slidable release of the floor or ceiling from the support member with the at least one securing member attached to the floor or ceiling when the fusible member is weakened by heat.

32. The break away connector system as claimed in claim 22 wherein the support member is fixedly secured to the firewall when the floor or ceiling is slidably disengagable from the support member.

33. The break away connector system as claimed in claim 22 wherein the support member is made of metal.

34. The break away connector system as claimed in claim 33 wherein the fusible member is made of plastic.

35. A method of constructing a firewall connection system, said method comprising:

a) providing a support member and a fusible member, the support member having at least one open-ended channel, whereby at least one securing member is slidably removable from the support member when the fusible member is weakened by heat;

b) securing a first section of the support member to a first structural member; and, c) securing a second section of the support member to a second structural member by passing the at least one securing member through the open-ended channel of the second section of the support member and the fusible member and into the second structural member.

36. The method of claim 35 wherein the fusible member has at least one opening and step (c) comprises passing the at least one securing member through the at least one opening of the fusible member.

37. The method of claim 36 further comprising positioning the fusible member in an abutting relationship with the support member.

38. The method of claim 35 further comprising interengagMg the support member and the fusible member.

* * * * *